United States Patent [19]

Reinhart

[11] Patent Number: 4,646,453

[45] Date of Patent: Mar. 3, 1987

[54] SCROLL TYPE CALENDAR DISPLAY DEVICE

[76] Inventor: Stanley I. Reinhart, 3124 Colorado Ave., Santa Monica, Calif. 90404

[21] Appl. No.: 759,132

[22] Filed: Jul. 25, 1985

[51] Int. Cl.[4] ..... G09D 3/10

[52] U.S. Cl. ..... 40/117; 40/518

[58] Field of Search ..... 40/518, 117, 347, 519, 40/514, 515, 116; 160/241, 291, 294, 299, 305, 323 R, 324

[56] References Cited

U.S. PATENT DOCUMENTS

| | | | |
|---|---|---|---|
| 387,784 | 8/1888 | Hack | 40/117 |
| 1,267,935 | 5/1918 | Townsend | 40/117 |
| 1,396,553 | 11/1921 | Bory | 40/518 |
| 1,415,886 | 5/1922 | Oppenheim | 40/117 |
| 1,684,682 | 9/1928 | Prettyman | 40/518 |
| 1,772,112 | 8/1930 | Rose | 40/117 |
| 2,193,277 | 3/1940 | Gordon | 40/117 |
| 3,316,668 | 5/1967 | Rogers | 40/117 |
| 4,203,234 | 5/1980 | Thenon | 40/519 |
| 4,345,392 | 8/1982 | Cornell | 40/514 |

*Primary Examiner*—Gene Mancene
*Assistant Examiner*—Cary E. Stone
*Attorney, Agent, or Firm*—Jacob Shuster

[57] ABSTRACT

A web backing support interconnecting tubular housings in spaced relation, extends through slots formed in extensions of closure caps coaxially mounted on the ends of the tubular housings to render the caps non-rotatable. Adjusting knobs axially fixed to scroll shafts rotationally supported by the end caps, within the tubular housings, are engaged by the end caps under spring bias to resist rotation of the scroll shafts and thereby yieldably hold the web in adjusted positions.

7 Claims, 4 Drawing Figures

SCROLL TYPE CALENDAR DISPLAY DEVICE

BACKGROUND OF THE INVENTION

This invention relates generally to calendar displays and more particularly to scroll types of displays.

Scroll types of displays are generally known for exhibiting monthly calendars printed on a continuous flexible web that is rolled up or wound upon parallel spaced scroll shafts having adjusting knobs secured to the axial ends thereof. In such displays, as disclosed for example in U.S. Pat. Nos. 387,784 and 1,267,935 portions of the web are stored on the scroll shafts within housing enclosures while a flat portion of the web is exposed between the parallel spaced scroll shafts to exhibit the calendars. The housing enclosures may be provided with end caps rotationally supporting the scroll shafts and the adjusting knobs attached thereto as shown for example in U.S. Pat. No. 387,784.

In order to simultaneously exhibit several monthly calendars by means of the aforementioned scroll type of display, the scroll shafts must be spaced a substantial distance from each other and a rigid support must be provided for backing the flat portion of the web extending between the scroll shafts. For such an arrangement, it is essential that the web be maintained in a taut condition between scroll shafts and held against displacement from any of its positions to which it is adjusted. Reliance on scroll shaft bearing friction or frictional contact with springs, as disclosed for example in U.S. Pat. No. 1,684,682, under such circumstances is inadequate. The provisions of special web holding facilities would of course be apparent to meet the problem involved. However, such a solution ordinarily introduces costly and structurally complicated modifications as well as to create additional problems.

It is, therefore, an important object of the present invention to provide a scroll type of display for selectively exhibiting large sections of a printed web in a trouble-free manner without costly and structurally complicated modification.

An additional object in accordance with the foregoing object is to provide a scroll type of display having a flexible web held in readily adjusted positions with relatively large exposed portions in taut and flat condition between scroll shafts.

SUMMARY OF THE INVENTION

In accordance with the present invention, a scroll type display is provided with a pair of scroll shafts rotationally supported within tubular housings by end closure caps that extend in axially overlapping relation to a web backing support interconnecting the tubular housings in spaced relation to each other. The caps are thereby rendered non-rotatable relative to the housings by being formed with slots through which the backing support extends to also accommodate limited axial displacement of the end caps. Springs mounted within each scroll shaft axially bias the end caps directly into engagement with the adjusting knobs. By means of the knobs the scroll shafts are rotated to displace the web by winding of the web onto one of the shafts. The adjusting knobs are accordingly connected by pins to the scroll shafts in axially fixed relation to the ends of the tubular housings on which the end caps are coaxially mounted. The pins extend through bearing openings in the end caps to rotationally support the scroll shafts within the tubular housings. The end caps thus perform various functions including rotational support of the scroll shafts, closure of the stored portion of the web within the tubular housings and hold the web taut in adjusted positions. Such web holding action is achieved by the clamping pressures exerted by the aforementioned springs on each of the axially displaceable end caps in engagement with the knobs at both axial ends of the scroll shafts.

Further objects and advantages of the present invention may be best understood by reference to the following detailed description taken in conjunction with the accompanying drawing.

BRIEF DESCRIPTION OF DRAWING FIGURES

FIG. 1 is a partial front elevation view of a scroll type calendar display device in accordance with one embodiment of the invention.

FIGS. 2 and 3 are enlarged partial section views taken substantially through planes indicated by section lines 2—2 and 3—3 in FIG. 1.

FIG. 4 is a perspective view of an end closure cap disassembled from the display device shown in FIG. 1.

DETAILED DESCRIPTION OF PREFERRED EMBODIMENT

Figure 1:
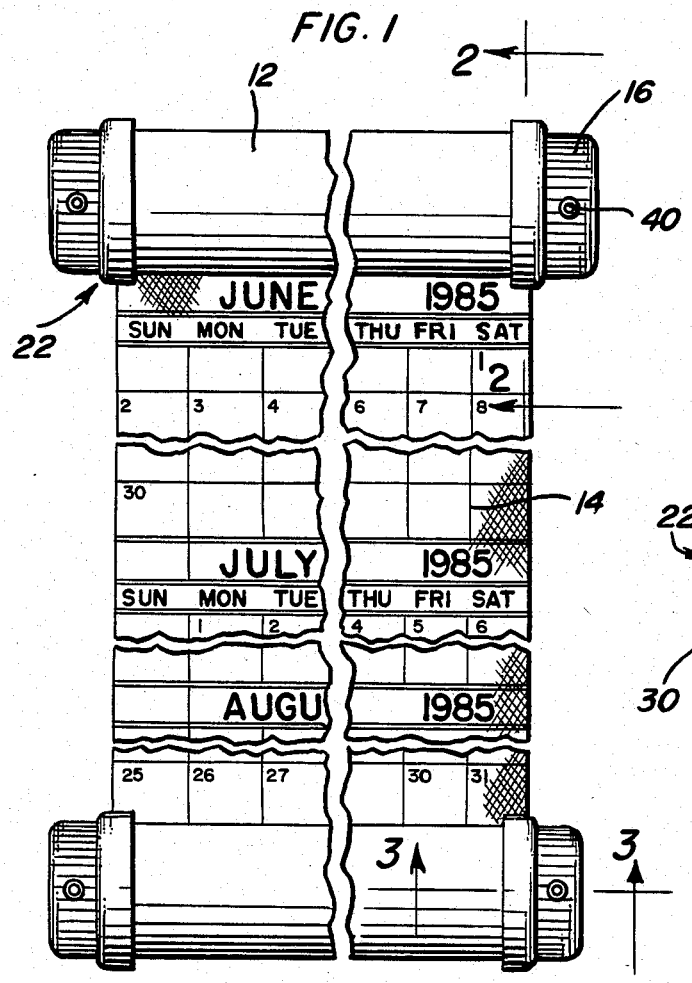

Referring now to the drawing in detail, one embodiment of a calendar display device is shown, generally denoted by reference numeral 10. The display device 10 as shown in FIG. 1 includes two parallel spaced and axially elongated tubular housings or containers 12 between which a continuous flexible web 14 extends exposing printed matter thereon in the form of monthly calendars. The web may be made of any suitable flexible material on which visual information may be printed or mounted including paper, textile cloth and the like. In the illustrated embodiment, the tubular housings 12 are horizontally positioned and vertically spaced a distance sufficient to simultaneously display three monthly calendars printed or otherwise exhibited on the web 14. The web is displaced between the housings 12 by rotation of manual adjusting knobs 16 in order to change the monthly calendars being exhibited. Portions of the web are stored within the housings 12 in scroll form 18 as more clearly seen in FIGS. 2 and 3.

Figure 3:
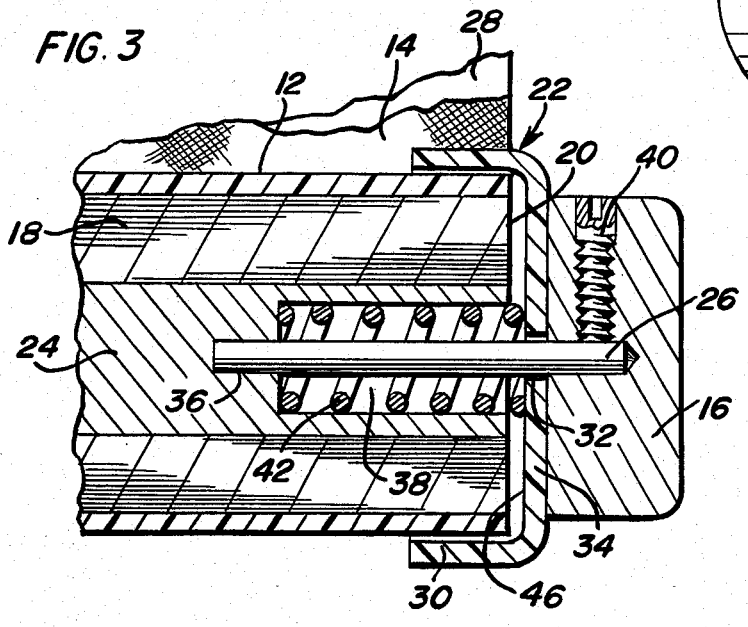

The tubular housings 12 are similar in construction to each other with opposite longitudinal ends 20 that are open as shown in FIG. 3. Each axial end 20 is closed by a closure cap generally referred to by reference numeral 22. Each of the four closure caps 22 has one of the adjusting knobs 16 mounted for axial abutment therewith. Each knob 16 is rotationally and axially fixed to one axial end portion of a scroll shaft or spool 24 by means of a spindle or connecting pin 26 in order to displace the web by winding its scroll portion 18 onto the scroll shaft 24 within one of the tubular housings 12. The ends of the web are accordingly secured to the two scroll shafts respectively enclosed within the spaced housings 12.

Figure 2:
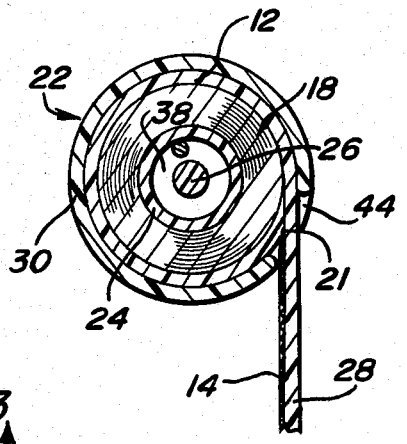

The tubular housings 12 are fixedly spaced in parallel relation to each other by means of a rigid flat bed plate or backing support 28 over which the web is drawn as more clearly seen in FIG. 2. In the illustrated embodiment, the support 28 is formed integral with the tubular housings 12 from which it extends tangentially to interconnect the same. Further, the support 28 is of a width substantially equal to the longitudinal lengths of the tubular housings and the width of the web 14. The support 28 therefore axially overlaps each of the closure caps 22 adjacent the axial ends 20 of the tubular housings 12 from which the web extends through longitudinal gaps 21 in the housings.

As more clearly seen in FIG. 3, each of the closure caps 22 includes an outer annular portion 30 coaxially positioned over a tubular housing 12 at each axial end 20 to not only close the open ends but to rotatably support the connecting pins 26 in substantially coaxial relation to the tubular housings. The connecting pins thus extend through bearing openings 32 centrally formed in the circular end panels 34 of the closure caps. The inner ends of the connecting pins are received with force fits within bores 36 formed in the scroll shafts 24 for rotational support of the scroll shafts within the tubular housings 12. The bores 36 open into cylindrical recesses 38 through which the pins 26 extend. The outer ends of the connecting pins 26 are received within the adjusting knobs 16 to which they are secured by setscrew fasteners 40. The setscrews 40 axially fix the knobs 16 through the pins 26 in close axially spaced relation to the ends 20 of the tubular housings thereby limiting axial displacement of the caps 22 between ends 20 and the knobs 16. The end closure caps 22 engage the axially fixed knobs under the bias of coil springs 42 seated within each of the recesses 38 at the opposite axial ends of the scroll shafts 24.

Figure 4:
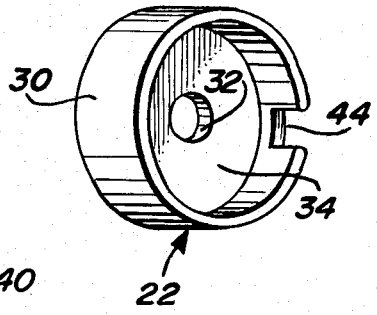

Each of the closure caps 22 has its annular portion 30 extended sufficiently to axially overlap the backing support 28 as aforementioned, such overlap being accommodated by slots 44 as more clearly seen in FIGS. 2 and 4. Thus, the web backing support 28 extends through each of the slots 44 to prevent the closure caps from being rotated with the scroll shafts by the adjusting knobs 16. The closure caps thereby also function to resist rotation of the scroll shafts 24 in order to yieldably hold the web in any adjusted position to which it is displaced. Such web holding function is achieved by virtue of each coil spring 42 being pre-stressed when assembled as shown in FIG. 3 to react between the scroll shaft and the inner surface 46 of the cap 22 to exert a holding pressure frictionally clamping the planar surface of the non-rotatable end panel portion 34 to a corresponding surface on the knob 16 as shown in FIG. 3.

It will be apparent from the foregoing description, that the web 14 may be displaced along the backing support 28 in one direction to change the calendars being displayed by manually rotating one or both of the knobs 16 associated with one of the two tubular housings 12, causing its scroll shaft 24 to wind up the scroll portion 18 therein while the scroll portion of the web in the other housing is unwound. Such displacement of the web is resisted by the clamping pressures exerted by all four coil springs 42 on the non-rotatable caps 22 in frictional engagement with the knobs 16 which are rotationally as well as axially fixed to the scroll shafts 24 by the setscrews 40. The caps 22 are rendered positively non-rotatable to perform the containing surfaces of the holding function because of the extension of the backing support 28 through the locking slots 44 in the annular portions 30 of the caps and the extension of portions 30 in axially overlapping relation to the support 28.

In the illustrated embodiment, the web 14 is vertically displaced between housings 12 that are horizontally positioned in vertically spaced relation to each other through any suitable mounting attachment to the support 28. It will, however, be apparent that the support 28 could be mounted for positioning the housings 12 vertically in horizontally spaced relation. In such case, the printed matter on the web would be orientated in 90° relation to that shown in FIG. 1 for horizontal displacement with the web 14.

Further, it will be appreciated by persons skilled in the art that various deviations from the described embodiment of the invention are possible and that many modifications and improvements may be made within the scope and spirit of the invention. Thus, it will be understood that the invention is not limited by the specific embodiment described, but only by the scope and spirit of the appended claims.

I claim:

1. In combination with a scroll type display comprising a pair of tubular housings having opposite axial ends, a continuous web having printed matter thereon, rotatable scroll shafts within the housings on which the web is wound, a support interconnecting the housings in spaced relation to each other and backing the web therebetween with the printed matter exposed, adjusting means connected to the scroll shafts for selective displacement of the web between the housings and means displacably positioned on the housings adjacent said axial ends for supporting the scroll shafts therein, the improvement comprising spring biased means operatively mounted for exerting a clamping pressure on the supporting means against the adjusting means, the supporting means and the adjusting means having frictional contacting surfaces held in engagement under said clamping pressure and positive locking means mounting the supporting means in operative engagement with the backing support for preventing rotation of the supporting means relative to the housings to resist rotation of the scroll shafts through said frictional contacting surfaces.

2. The combination of claim 1 wherein the supporting means includes end caps at said axial ends of the housings, and means for positioning the end caps in coaxial relation to the tubular housings, said locking means including annular extensions of the end caps axially overlapping the backing support, said annular extensions having slots formed therein through which the backing support extends to lock the end caps against rotation relative to the tubular housings.

3. The improvement as defined in claim 1 wherein said adjusting means comprises knobs rotationally fixed to the scroll shafts in axial abutment with the supporting means under the damping pressure of said spring biased means.

4. The improvement as defined in claim 1 including means independent of the supporting means for securing the adjusting means to the scroll shafts in axially fixed relation thereto.

5. In a scroll type display device including a pair of tubular housings having opposite axial ends, a continuous web having printed matter thereon, rotatable scroll shafts within the housings on which the web is wound, a support interconnecting the housings in spaced relation to each other and backing the web therebetween with the printed matter exposed, adjusting means connected to the scroll shaft for relative displacement of the web between the housings and closure caps mounted on said tubular housings at said axiasl ends thereof, the improvement comprising locking means on the caps engageable with the backing support for preventing rotation of the caps relative to the housings and spring biased means engagable with the caps for yieldably resisting rotation of the scroll shafts within the housings to hold the web in adjusted positions, said locking means including axial extensions of the closure caps projecting in axially overlapping relation to the backing support, said axial extensions having slots therein through which the backing support extends from the tubular housings.

6. The improvement as defined in claim 5 including means securing the adjusting means to the scroll shafts in axially fixed relation thereto for abutment by the closure caps under the bias of aid spring biased means exerting clamping pressure on the caps.

7. In a display device, spaced tubular containers having opposite axial ends, an intervening bed plate interconnecting said containers, end caps having flanges fitting over the ends of said containers, spools enclosd within the containers, a web wound on the spools and extending between the containers in sliding contact with the bed plate, spindles connected to and projecting from the spools through the end caps and knobs axially and rotationally fixed to the spindles, the improvement residing in said end caps being slidable on the ends of the containers and having rotational locking slots in the flanges thereof through which the bed plate extends in axially overlapping relation thereto, said knobs having contacting surfaces axially engageable by the end caps and spring means axially biasing the end caps into frictional engagement with the contacting surfaces of the knobs for yieldably holding the web in adjusted positions on the bed plate.

* * * * *